United States Patent [19]

Germershausen et al.

[11] Patent Number: 4,773,328

[45] Date of Patent: Sep. 27, 1988

[54] METHOD OF ACTUATING A PROXIMITY FUZE AND DEVICE FOR IMPLEMENTING THE METHOD

[75] Inventors: Raimund Germershausen; Rudolf Romer, both of Kaarst; Hans-Egon Schepp, Düsseldorf, all of Fed. Rep. of Germany

[73] Assignee: Rheinmetall GmbH, Düsseldorf, Fed. Rep. of Germany

[21] Appl. No.: 16,722

[22] PCT Filed: Feb. 25, 1986

[86] PCT No.: PCT/EP86/00098

§ 371 Date: Dec. 22, 1986

§ 102(e) Date: Dec. 22, 1986

[87] PCT Pub. No.: WO86/06470

PCT Pub. Date: Nov. 6, 1986

[30] Foreign Application Priority Data

Apr. 25, 1985 [DE] Fed. Rep. of Germany ..... 3514893

[51] Int. Cl.[4] ..... F42C 13/04; F42C 13/00

[52] U.S. Cl. ..... 102/214; 102/211

[58] Field of Search ..... 102/211, 212, 213, 214, 102/397

[56] References Cited

U.S. PATENT DOCUMENTS

| | | | |
|---|---|---|---|
| 3,858,207 | 9/1966 | Macomber et al. | 102/214 |
| 4,583,461 | 4/1986 | Weber | 102/214 |
| 4,651,647 | 3/1987 | Baker | 102/214 |

FOREIGN PATENT DOCUMENTS

| | | | |
|---|---|---|---|
| 066168A1 | 12/1982 | European Pat. Off. . | |
| 0127805 | 6/1983 | European Pat. Off. . | |
| 1097855 | 3/1966 | United Kingdom . | |
| 2052021 | 5/1980 | United Kingdom . | |
| 2063430 | 6/1981 | United Kingdom | 102/214 |
| 2133514A | 7/1984 | United Kingdom . | |

*Primary Examiner*—Charles T. Jordan

*Attorney, Agent, or Firm*—Spencer & Frank

[57] ABSTRACT

A firing circuit for a projectile 10 includes a proximity fuze 11 which can be set to different target distances H1, H2. For the purpose of optimally combating different types of targets 13, 14, 15, a target sensor 17 is associated with the proximity fuze 11 so as to detect characteristic target properties and take care that proximity fuze 11 responds either at a height H1 or at a lower height H2, and causes an explosive charge 10*a* to detonate.

7 Claims, 2 Drawing Sheets

METHOD OF ACTUATING A PROXIMITY FUZE AND DEVICE FOR IMPLEMENTING THE METHOD

BACKGROUND OF THE INVENTION

The invention relates to a method of actuating a proximity fuze and to a device for implementing the method.

To effectively combat certain types of targets, high explosive projectiles must be caused to detonate at an optimum distance from the respective target. For combatting semi-hard targets, for example, the optimum detonation point lies some 10 m above the target so that the effective units, e.g. fragments released with high kinetic energy by the detonation of the projectile, penetrate such targets from the top. However, to combat soft targets, a lower detonation point is preferred, e.g. a few meters above the target, since such targets are preferably combatted from the side.

High explosive projectiles equipped with proximity fuzes are already known for combatting various types of targets, with the optimum firing distance being set by the operating crew immediately before firing of the projectile. If there is stress from extraordinary combat situations and/or in darkness, operator errors cannot be excluded, so that the projectile may not become optimally effective because of a wrongly set proximity fuze.

Finally, the correct setting of the proximity fuze also depends on excellent and always up to date reconnaissance results which are not available under all combat conditions.

SUMMARY OF THE INVENTION

It is the object of the invention to provide a method of actuating a proximity fuze while avoiding the above-mentioned error sources and assuring optimum use of the projectile. Moreover, a device is to be provided for implementing the method.

Based on a method of the type described in greater detail above, this is accomplished by providing a target sensor which detects characteristic properties of targets disposed in the target area, and controlling the proximity fuze to respond at different heights above the earth's surface depending upon the type of target detected by the target sensor.

DESCRIPTION OF THE PREFERRED EMBODIMENT

Figure 1:
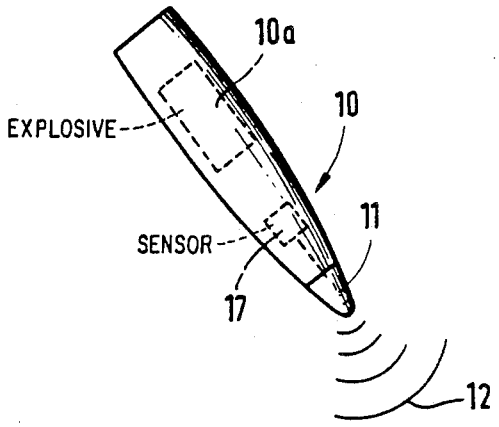
FIG. 1 is a schematic representation of a projectile flying over a target area.
Figure 1:
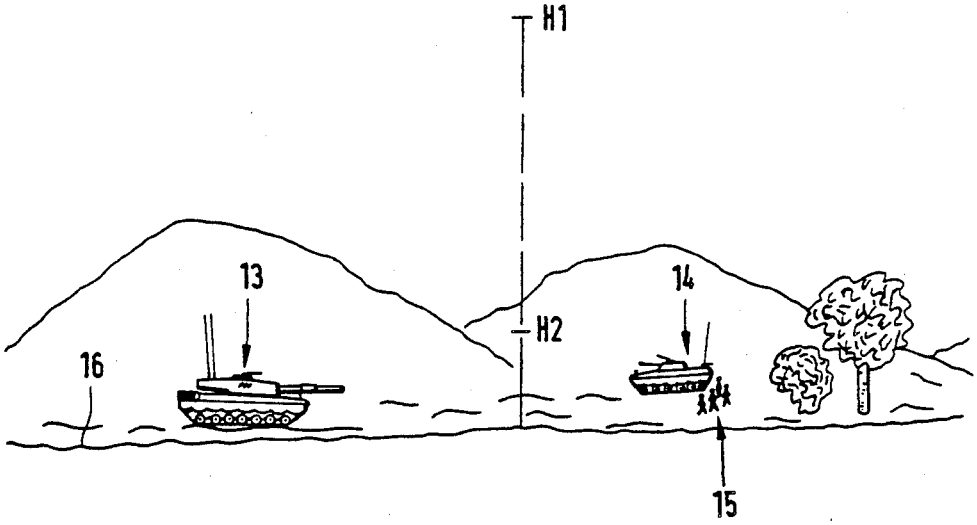

FIG. 1 is a schematic representation of a projectile 10 which is in the final phase of its flight toward a target area in which various types of targets may be detected, e.g. hard targets 13, semi-hard targets 14 and soft targets 15. Projectile 10 transports an explosive charge 10*a* which must be detonated at an optimum height above the target in order to effectively combat it.

For this purpose, projectile 10 is equipped with an adjustable proximity fuze 11 which is able to measure the height of projectile 10 above the ground and above a target, respectively, and to cause the explosive charge 10*a* to detonate when the set optimum height is reached. Advisably, proximity fuze 11 may operate according to the radar principle or photo-optically. Conventional firing circuits permit response of the proximity fuze 11 at a predetermined height above the ground as a result of programming or setting at firing. Whether this height is actually the optimum combat height above the target depends on the quality of the reconnaissance results and is therefore fraught with great uncertainty. The invention avoids this drawback in that it additionally provides a target sensor 17 within projectile 10. This target sensor is able to distinguish between different types of targets and is coupled with proximity fuze 11 in such a manner that—dependent on the detection of a certain type of target—it causes proximity fuze 11 to respond at the height optimum for combatting the detected target. For example, target sensor 17 may be a metal detector which reacts when it approaches metal masses and is thus able to detect armored and/or unarmored vehicles. According to a further variation of the invention, target sensor 17 also operates according to the radar principle and is able to detect the presence of metal targets by transmitting and receiving, in particular, the radiation reflected by such metal targets. If a semi-hard metal target is recognized, target sensor 17 causes proximity fuze 11 to respond at the detonation height H1 above the ground which is optimum for this type of target, i.e. at a height of some 10 m.

In this way, target types 13 and 14 are effectively combated, particularly by high kinetic energy fragments formed of the body of projectile 10 during detonation of explosive charge 10*a*. If target sensor 17 does not detect a target of the hard or semi-hard type 13 or 14, it prevents response of proximity fuze 11 until projectile 10 has reached height H2 above the ground which is optimum for combatting a soft target. Since this optimum detonation height need no longer be set manually and the actual combat field situation is not evaluated until immediately during the final flight phase of projectile 10, operator errors and wrong detonation heights can be avoided so that the attack on the target will be extremely effective.

Figure 2:
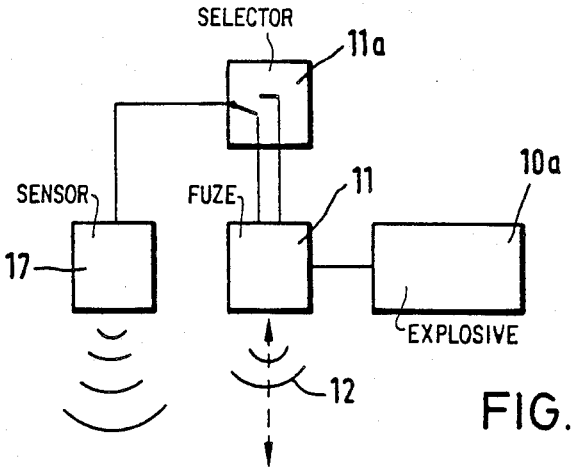
FIG. 2 is a block circuit diagram of the device.

FIG. 2 is a block circuit diagram of the device for implementing the method. Proximity fuze 11 is connected with an explosive charge 10*a*. In a proximity fuze 11 operating according to the radar principle, the height above the target area is measured by transmitting and receiving reflected radio waves 12. By means of known programs, proximity fuze 11 can be caused to respond, for example, at two different heights H1 and H2, respectively, and detonate explosive charge 10*a*. Connected with proximity fuze 11 is a target sensor 17 which is able to detect certain target characteristics. This may be, for example, a metal detector which detects the presence of metal components or also a radar transmitter/receiver which, on the basis of the emitted and reflected electromagnetic energy, detects the presence of a likewise preferably metal target.

Figure 3:
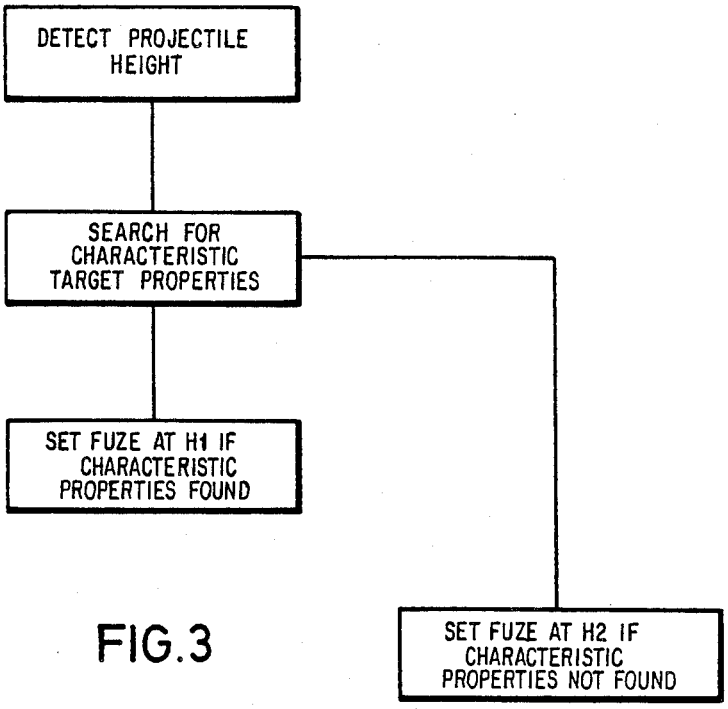
FIG. 3 is a flow diagram schematically illustrating the sequence of operation.

This target sensor 17 is linked with proximity fuze 11 by way of a switching member or selector 11*a*, shown only schematically, in order to monitor the moment of detonation at a certain height above the ground or above a target, respectively. In a first switch position, proximity fuze 11 is able to respond at height H1 above the earth's surface 16, while in the second switch position, it is not caused to operate until it reaches height H2. This sequence is shown once more in the diagram of FIG. 3.

What is claimed is:

1. A method of actuating a proximity fuze in a projectile which is fired at a target in a target area, said proximity fuze being adjustable for different target distances, comprising: providing a target sensor in the projectile to detect characteristic properties of targets disposed in the target area; and controlling the proximity fuze to respond at different heights above the earth's surface depending upon the type of target detected by the target sensor.

2. A device for actuating a proximity fuze in a projectile which is fired at a target in a target area, said proximity fuze being adjustable for different target distances, comprising:

a target sensor provided in the projectile to detect characteristic properties of targets disposed in the target area; and means for setting the proximity fuze to respond at different heights above the earth's surface depending upon the type of target detected by the target sensor.

3. A device according to claim 2, wherein the target sensor comprises a metal detector.

4. A device according to claim 3, wherein the target sensor and proximity fuze are structurally combined and include a radar transmitter/receiver with which the height of the projectile above the ground as well as characteristic target properties can be detected.

5. A device according to claim 2, wherein the target sensor and proximity fuze are structurally combined and include a radar transmitter/receiver with which the height of the projectile above the ground as well as characteristic target properties can be detected.

6. A device according to claim 2, wherein the target sensor comprises a radar transmitter/receiver.

7. A device according to claim 2, wherein the target sensor comprises a metal detector and a radar transmitter/receiver.

* * * * *